US007122998B2

(12) United States Patent
Chen

(10) Patent No.: US 7,122,998 B2
(45) Date of Patent: Oct. 17, 2006

(54) CURRENT SUMMING LOW-VOLTAGE BAND GAP REFERENCE CIRCUIT

(75) Inventor: Chung-Hui Chen, Hsin Chu (TW)

(73) Assignee: Taiwan Semiconductor Manufacturing Company, Hsin-Chu (TW)

( * ) Notice: Subject to any disclaimer, the term of this patent is extended or adjusted under 35 U.S.C. 154(b) by 309 days.

(21) Appl. No.: 10/804,708

(22) Filed: Mar. 19, 2004

(65) Prior Publication Data

US 2005/0206362 A1 Sep. 22, 2005

(51) Int. Cl.
*G05F 3/16* (2006.01)

(52) U.S. Cl. ..... 323/314; 323/316; 323/907

(58) Field of Classification Search ..... 323/313, 323/314, 315, 316, 907
See application file for complete search history.

(56) References Cited

U.S. PATENT DOCUMENTS 5,325,045 A * 6/1994 Sundby ..... 323/313
6,060,874 A * 5/2000 Doorenbos ..... 323/316
6,111,397 A * 8/2000 Leung ..... 323/315
6,133,718 A * 10/2000 Calafato et al. ..... 323/312
6,208,549 B1 3/2001 Rao et al. ..... 365/96
6,288,525 B1 * 9/2001 Fischer ..... 323/313
6,436,738 B1 8/2002 Yu ..... 438/132
6,445,606 B1 9/2002 Khoury ..... 365/96
6,507,087 B1 1/2003 Yu ..... 257/529
6,642,699 B1 * 11/2003 Gregoire, Jr. ..... 323/314
6,819,093 B1 * 11/2004 Kay ..... 323/315
6,873,143 B1 * 3/2005 Moon et al. ..... 323/312

OTHER PUBLICATIONS

Ker, Ming-Dou et al., "Capacitor-Couple ESD Protection Circuit for Deep-Submicron Low-Voltage CMOS Asic", IEEE Transactions on Very Large Scale Integration (VLSI) Systems, vol. 4, No. 3, (Sep. 1996), pp. 307-321.
Ker, Ming-Dou et al., "Complementary-SCR ESD Protection Circuit With Interdigitated Finger-Type Layout for Input Pads of Submicron CMOS IC'S", IEEE Transactions on Electron Devices, vol. 42, No. 7, (Jul. 1995), pp. 1297-1304.
Wu et al., A New On-Chip ESD Protection Circuit With Dual Parasitic SCR Structures for CMOS VLSI, IEEE Journal of Solid-State Circuits, vol. 27, No. 3, (Mar. 1992), pp. 274-280.

* cited by examiner

*Primary Examiner*—Jeffrey Sterrett
(74) *Attorney, Agent, or Firm*—Duane Morris LLP

(57) ABSTRACT

A system and method is disclosed for providing a bandgap reference voltage generator that can successfully operate with a low operating voltage. Three current sources are controlled to provide same amount of current through three paths. The first current source is used to enable a first negative temperature coefficient module, while the second and third current sources are used to enable a first positive temperature coefficient module. The three current sources together are used to enable a reference voltage output module, which is connected to a current summing module for producing a bandgap reference voltage independent of temperature variations.

22 Claims, 2 Drawing Sheets

CURRENT SUMMING LOW-VOLTAGE BAND GAP REFERENCE CIRCUIT

BACKGROUND

The present disclosure relates generally to electronic circuits, and more particularly to bandgap reference circuits. Still more particularly, the present disclosure relates to bandgap reference circuits that can operate at a low voltage.

Reference circuitries generate reference voltages and currents that are used in a variety of semiconductor applications, including flash memories, Dynamic Random Access Memories (DRAMs) and analog devices. These circuitries are required to be stabilized despite process and temperature variations, and must be implemented without modification of its fabrication process. A reference voltage that exhibits little dependence on temperature is essential in many analog circuits. If a voltage reference is temperature independent, it is usually process independent as well, since variations in most process parameters affect voltage reference through variations in temperature.

A conventional bandgap reference generator is one of the more popular reference voltage generators that can stabilize reference voltage despite process and temperature variations. Bandgap is the energy gap in a semiconductor that separates the valence band, where electrons cannot conduct, and the conduction band, where electrons can conduct. A bandgap reference generator typically operates by creating a device that has a nominally zero temperature coefficient. One method of achieving the nominally zero temperature coefficient is to use a positive temperature coefficient of one part of the device to cancel out a negative temperature coefficient of the other part of the device.

Bipolar transistors may be used for forming the bandgap reference circuits. The base-emitter voltage of a bipolar transistor typically exhibits a negative temperature coefficient. The difference between the base-emitter voltages of two bipolar transistors with unequal current densities operating together exhibit a positive temperature coefficient. Therefore, a bandgap voltage generator may be designed by connecting two bipolar transistors in parallel with unequal current densities and ensuring that the positive and negative temperature coefficients cancel each other out.

Typically, the minimum operating voltage to drive a reference voltage generator must exceed 1.25 volts, or the bandgap voltage of silicon, because the common-collector structure of a bipolar transistor and the input common-mode voltage of an amplifier require at least that much voltage to drive any bandgap reference voltage generator.

However, with the spread of battery-operated, portable applications such as cellular phones and wearable computing devices, device designs increasingly demand low-power and low-voltage circuitries due to power supply limitations. In addition, advanced deep sub-micron Complementary Metal-Oxide-Semiconductor (CMOS) technologies require low power supply voltage. Therefore, it is understood that in the near future, the operating voltage of most devices will be below 1 volt.

Desirable in the art of bandgap reference voltage generator designs are additional designs and methods with which bandgap reference circuitries can successfully operate with a low operating voltage such as one below one volt.

SUMMARY

In view of the foregoing, this disclosure provides a system and method for providing a bandgap reference voltage generator that can successfully operate with a low operating voltage. Three current sources are controlled to provide the same amount of current through three paths. The first current source is used to enable a first negative temperature coefficient module, while the second and third current sources are used to enable a first positive temperature coefficient module. The three current sources together are used to enable a reference voltage output module, which is connected to a current summing module for producing a bandgap reference voltage independent of temperature variations.

In one example, a bandgap reference circuit comprises first, second and third current sources CS1, CS2, and CS3 adjusted to have the same current, the first current source feeding into a first BJT device module Q1, the second current source feeding into a second BJT device module Q2 through a first resister R1, and the third current source connecting to a grounding voltage supply through a second resister R2. Other components of the circuit include a first voltage passing unit connecting an output of CS1 as its input and connecting its output to a first end of a third resister R3 and a first output of a current summing circuit; a second voltage passing unit connecting an output of CS3 as its input and feeding its output to a first end of a fourth resistor R4 and a second output of the current summing circuit; and a fifth resister R5 connecting to a third output of the current summing circuit on a first end and the grounding voltage supply on a second end thereof. In such a circuit, a first current through R5 bears a linear relationship with a summation of a second current through R3 and a third current through R4, and the outputs of the first and second voltage passing units track their respective inputs, and predetermined values for R1, R2, R3, R4, and R5 are selected in conjunction with selections Q1 and Q2 so that a reference voltage of the circuit across R5 is independent of temperature variations.

Various aspects and advantages will become apparent from the following detailed description, taken in conjunction with the accompanying drawings, illustrating the principles of the disclosure by way of examples.

DESCRIPTION

Figure 1:
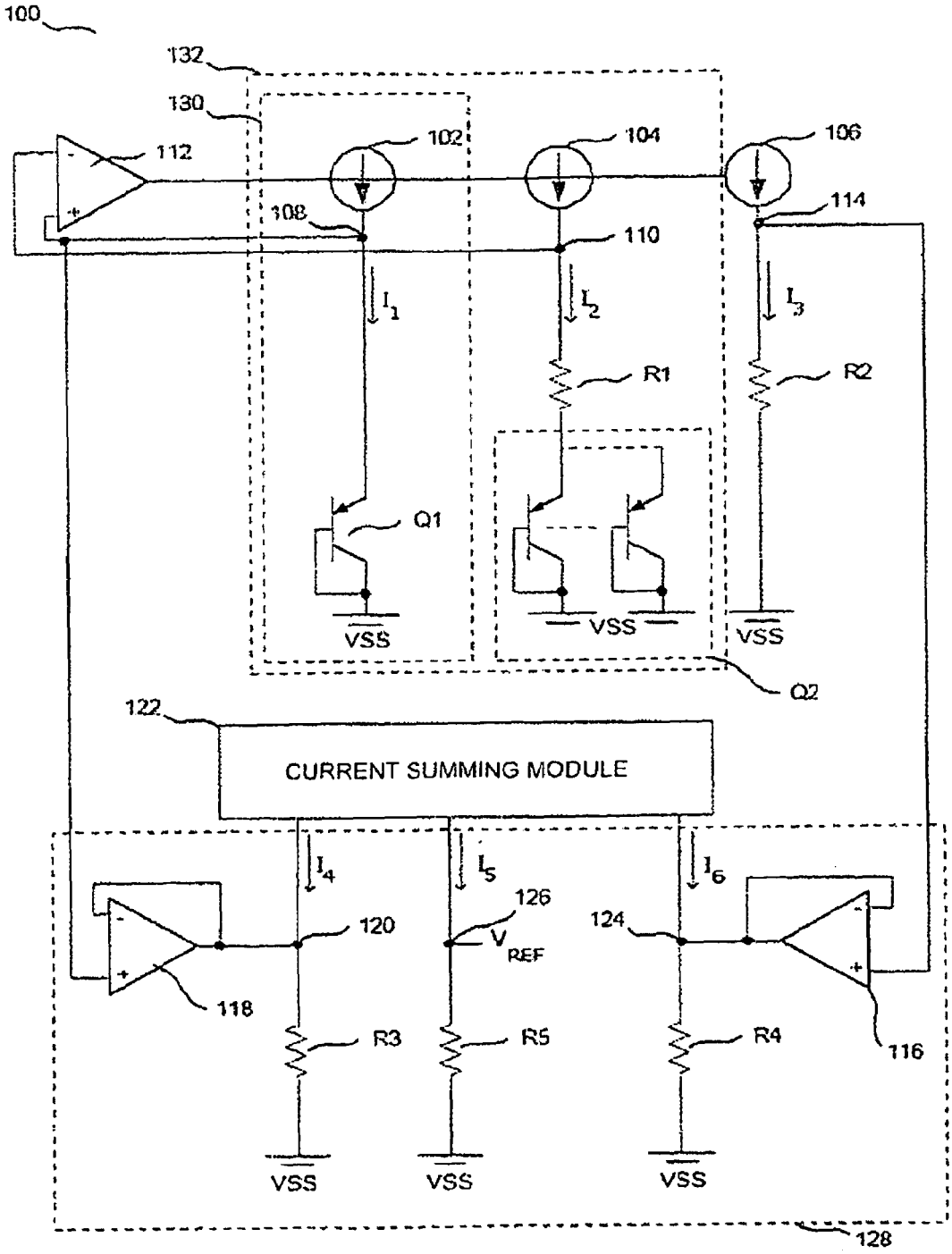
FIG. 1 illustrates a schematic of a bandgap reference voltage generator in accordance with one example of the present disclosure.

In the present disclosure, a bandgap reference voltage generator and a method to operate the same are disclosed. In FIG. 1, a bandgap reference voltage generator 100 is presented. The bandgap reference voltage generator 100 includes three current sources 102, 104, and 106, whose current outputs are $I_1$, $I_2$ and $I_3$, respectively. The current outputs of current sources 102 and 104 are connected, respectively via nodes 108 and 110, to the positive and negative input terminals, respectively, of an operational amplifier 112. The output of the operational amplifier 112 is designed and fed to current sources 102,104 and 106 in such a way that $I_1$, $I_2$ and $I_3$ are all equal to one and another. The operational amplifier 112 is further designed in such a way that the voltage at node 108, or $V_{108}$, is equal to the voltage at node 110, or $V_{110}$, since amplifier's output feedbacks, through nodes 108 and 110, into the positive and negative input terminals of the amplifier. The output of current source 102 is further connected, via node 108, to the emitter of a pnp bipolar junction transistor (BJT) Q1. The output of current source 104 is further connected, via node 110, to a resistor R1, which is further connected to a pnp BJT Q2. Q2 is designed so that it has a larger base emitter area than Q1 (or, having several BJTs connect in parallel). For example, the base emitter area of Q2 may be eight times the base emitter area of Q1. The bases and collectors of BJTs Q1 and Q2 are connected to VSS. It is typical that VSS is connected to ground. As such, VSS may be referred to as a grounding voltage supply for the purpose of this disclosure.

The output of current source 106 is connected, via a node 114, to a resistor R2, which is further connected to VSS. The output of current source 106 is also connected, via node 114, to the positive input terminal of a unit-gain operational amplifier 116, whose output terminal is fed back to its negative input terminal. Similarly, the output of current source 102 is also connected, via node 108, to the positive input terminal of a unit-gain operational amplifier 118, whose output terminal is fed back to its negative input terminal. The output terminal of operational amplifier 118 is connected to a node 120, which is further connected to a current summing module 122 and one end of a resistor R3, whose other end is connected to VSS. Since operational amplifier 118 is a unit-gain amplifier, the voltage at node 108 is carried to node 120. The output terminal of operational amplifier 116 is connected to a node 124, which is further connected to current summing module 122 and one end of a resistor R4, whose other end is connected to VSS. Since operational amplifier 116 is a unit-gain amplifier, the voltage at node 114 is carried to node 124. The current summing module 122 is also connected to a node 126, whose voltage, or $V_{REF}$, is the reference voltage of the bandgap reference voltage generator 100. Node 126 is further connected to one end of a resistor R5, whose other end is connected to VSS. The combination of unit-gain amplifiers 116 and 118, as well as resistors R3, R4 and R5 can be seen as a reference voltage output module 128, which generates the output voltage $V_{REF}$. The combination of current source 102 and BJT Q1 can be seen as a negative temperature coefficient module 130, while the combination of current sources 102 and 104, resistor R1, and BJTs Q1 and Q2 can be seen as a positive temperature coefficient module 132.

The currents going through nodes 120, 126 and 124 are respectively $I_4$, $I_5$ and $I_6$. The current summing module 122 operates in such a way that $I_5$ is equal to the sum of $I_4$ and $I_6$. To summarize, the bandgap reference voltage generator 100 has two main properties:

$$I_1=I_2=I_3 \quad \text{(Equation 1A)}$$

$$I_5=A\times(I_4+I_6) \quad \text{(Equation 1B)}$$

where A is a factor to show that $I_5$ bear a linear relation with the summation of $I_4$ and $I_6$ (or is proportional to the summation of $I_4$ and $I_6$). For the illustration below, A is deemed to be "1" for simplification. Furthermore, the base-emitter voltage of BJT Q1, or $V_{be1}$, is equal to $V_{108}$:

$$V_{108}=V_{be1} \quad \text{(Equation 2)}$$

and the base-emitter voltage of BJT Q2, or $V_{be2}$, is equal to $V_{110}$ minus the voltage drop across resistor R1, which is $I_2$*R1. Since operational amplifier 112 forces $V_{108}$ and $V_{110}$ to equate, the following relationship is true:

$$V_{be1}=V_{be2}+I_2*R1 \quad \text{(Equation 3)}$$

After rearranging Equation 3, the following is derived:

$$I_2=(V_{be1}-V_{be2})/R1 \quad \text{(Equation 4)}$$

Voltage at node 114, or $V_{114}$, is equal to the voltage drop across resistor R2:

$$V_{114}=I_3*R2 \quad \text{(Equation 5)}$$

Since according to Equation 1A, $I_3$ is equal to $I_2$, Equation 5 can be rewritten as:

$$V_{114}=I_2*R2 \quad \text{(Equation 6)}$$

Substituting Equation 4 into Equation 6, the following is true:

$$V_{114}=(V_{be1}-V_{be2})*(R2/R1) \quad \text{(Equation 7)}$$

The voltage at node 120, or $V_{120}$, and the voltage at node 124, or $V_{124}$, are as follows:

$$V_{120}=I_4*R3 \quad \text{(Equation 8); and}$$

$$V_{124}=I_6*R4 \quad \text{(Equation 9)}$$

Since it is established earlier that $V_{108}$ is equivalent to $V_{120}$, and that $V_{114}$ is equivalent to $V_{124}$, Equations 8 and 9 can be rewritten into Equations 10 and 11, respectively, as follows:

$$I_4=V_{108}/R3 \quad \text{(Equation 10); and}$$

$$I_6=V_{114}/R4 \quad \text{(Equation 11)}$$

Substituting Equation 2 into Equation 10, the following is true:

$$I_4=V_{be1}/R3 \quad \text{(Equation 12)}$$

Then, substituting Equation 7 into Equation 11, the following is true:

$$I_6=(V_{be1}-V_{be2})*(R2/(R1*R4)) \quad \text{(Equation 13)}$$

Substituting Equations 12 and 13 into Equation 1B. the following is derived:

$$I_5=V_{be1}/R3+(V_{be1}-V_{be2})*(R2/(R1*R4)) \quad \text{(Equation 14)}$$

The output voltage or the voltage at node 126 (i.e., $V_{REF}$) is:

$$V_{REF}=I_5*R5 \quad \text{(Equation 15)}$$

Substituting Equation 14 into Equation 15, the following is derived:

$$V_{REF}=V_{be1}*(R5/R3)+(V_{be1}-V_{be2})*((R2*R5)/(R1*R4)) \quad \text{(Equation 16)}$$

Taking the consideration of temperature dependence, the change in $V_{REF}$, or $dV_{REF}$, with respect to change in temperature, or dT, is as follows:

$$dV_{REF}/dT=(R5/R3)*dV_{be1}/dT+((R2*R5)/(R1*R4))*d(V_{be1}-V_{be2})/dT \quad \text{(Equation 17)}$$

If the change in reference voltage with respect to the change in temperature is zero, reference voltage is no longer dependent on a change in temperature. Therefore, if $dV_{REF}/dT=0$, the following is true:

$$dV_{be1}/d(V_{be1}-V_{be2})=-((R3*R2)/(R1*R4)) \quad \text{(Equation 18)}$$

Therefore, by choosing the right values for R1, R2, R3 and R4 with respect to $dV_{be1}/d(V_{be1}-V_{be2})$, thereby rendering $dV_{REF}/dT=0$, a bandgap reference voltage that is independent of temperature variations can be generated.

Figure 2:
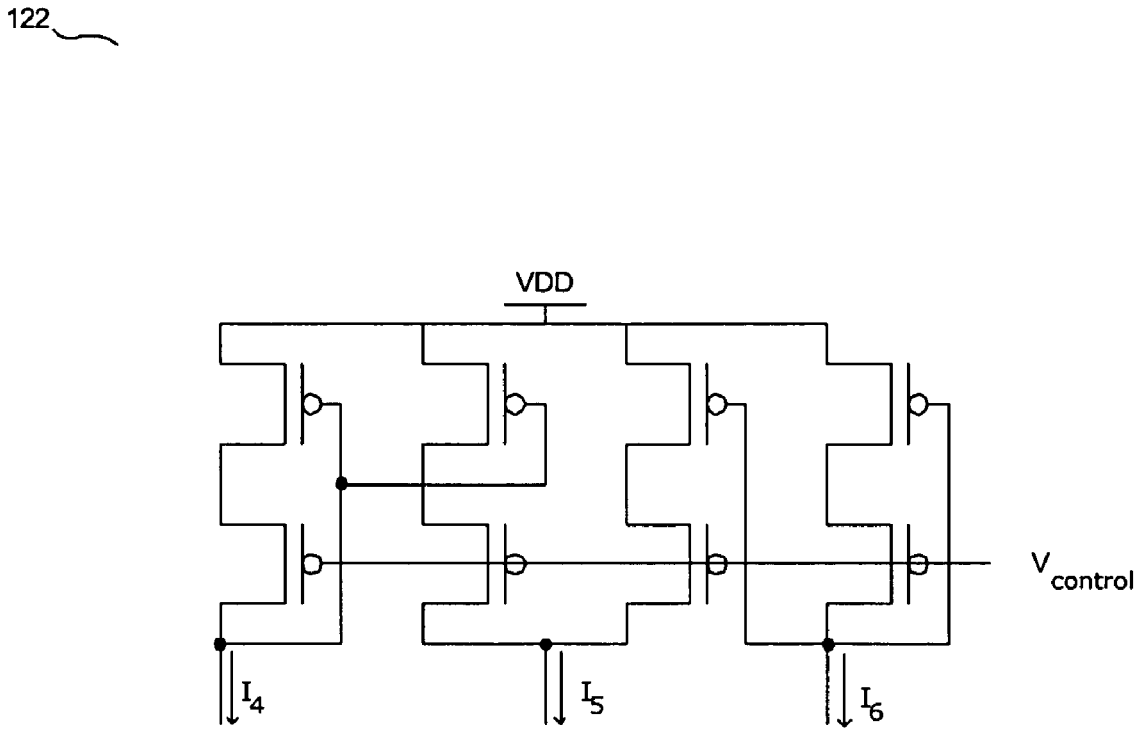
FIG. 2 illustrates a sample schematic of a current summing circuit used for the bandgap reference voltage generator of FIG. 1.

FIG. 2 illustrates a sample schematic of a current summing module 122 used for the bandgap reference voltage generator of FIG. 1. The current summing module can vary in many different ways as long as the three current paths bear the linear relationship as described above.

Since the highest voltage in the bandgap reference voltage generator 100 is $V_{be1}$, which is typically less than 1 volt, or $V_{REF}$, the operating voltage for this design can be lower than 1 volt. As an example, and depending upon the size of BJTs Q1 and Q2, the bandgap reference voltage generator 100 can operate with an operating voltage such as 500–700 mV and as low as $V_{120}$ plus 50 mV. Since the rest of the circuit is independent of the level of the operating voltage, an operating voltage below 1 volt is sufficient to drive the bandgap reference voltage generator 100, thereby generating a reference voltage independent of temperature variations in accordance with this disclosure.

The above disclosure provides many different embodiments, or examples, for implementing different features of the disclosure. Specific examples of components, and processes are described to help clarify the disclosure. These are, of course, merely examples and are not intended to limit the disclosure from that described in the claims.

Although illustrative embodiments of the disclosure have been shown and described, other modifications, changes, and substitutions are intended in the foregoing disclosure. Accordingly, it is appropriate that the appended claims be construed broadly and in a manner consistent with the scope of the disclosure, as set forth in the following claims.

The invention claimed is:

1. A bandgap reference circuit comprising:

first, second and third current sources (102, 104, and 106) adjusted to have the same current, the first current source feeding into a first BJT device module (Q1), the second current source feeding into a second BJT device module (Q2) through a first resistor (R1), and the third current source connecting to a grounding voltage supply through a second resistor (R2);

a current summing circuit;

a first voltage passing unit connecting an output of the first current source as its input and connecting its output to a first end of a third resistor (R3) and a first output of the current summing circuit;

a second voltage passing unit connecting an output of the third current source as its input and feeding its output to a first end of a fourth resistor (R4) and a second output of the current summing circuit;

a fifth resistor (R5) connecting to a third output of the current summing circuit on a first end and the grounding voltage supply on a second end thereof, wherein a first current through the fifth resistor bears a substantially linear relationship with a summation of a second current through the third resistor and a third current through the fourth resistor, wherein the outputs of the first and second voltage passing units track their respective inputs, and wherein by selecting predetermined values for the first, second, third, fourth, and fifth resistors in conjunction with selections of the first BJT device module and the second BJT device module, a reference voltage of the circuit across R5 the fifth resistor is independent of temperature variations.

2. The circuit of claim 1 further comprises an operational amplifier with its positive input connected to the output of the first current source and negative input connected with the output of the second current source.

3. The circuit of claim 1 wherein the current summing circuit provides the first current through the fifth resistor equal to the summation of the second and third currents through the third resistor and the fourth resistor.

4. The circuit of claim 1 wherein the second BJT device module has a predetermined number of BJT transistors connected in parallel.

5. The circuit of claim 1 wherein the reference voltage is less than or equal to about 1V.

6. The circuit of claim 1 wherein a supply voltage of the circuit is less than about 1V.

7. The circuit of claim 1 wherein the first BJT device module is a pnp type and receives the output of the first current source at its emitter, and wherein the second BJT device module is a pnp type and receives the output of the second current source at its emitter through the first resistor.

8. The circuit of claim 7 wherein a predetermined relationship among an emitter voltage of Q1 ($V_{be1}$) and an emitter voltage of Q2 ($V_{be2}$) may be expressed mathematically by $(R5/R3)*dV_{be1}/dT+((R2*R5)/(R1*R4))*d(V_{be1}-V_{be2})/dT=0$, wherein $dV_{be1}/dT$ and $d(V_{be1}-V_{be2})/dT$ are respective changes of the emitter voltage of the first BJT device module and a difference between the emitter voltages of the first and second BJT device modules with respect to temperature.

9. The circuit of claim 1 wherein the first and second BJT device modules have their collectors grounded so that the reference voltage ($V_{REF}$) an emitter voltage of Q1 ($V_{be1}$), an emitter voltage of Q2 ($V_{be2}$), and the resistors bear a predetermined relationship as represented mathematically by $V_{REF}=V_{be1}*(R5/R3)+(V_{be1}-V_{be2})*((R2*R5)/(R1*R4))$.

10. The circuit of claim 1 wherein the first and second voltage passing units are unit gain butters.

11. A bandgap reference circuit comprising:

first, second and third current sources (102, 104, and 106) with an output of the first current source output feeding into a first BJT device module (Q1), an output of the second current source feeding into a second BJT device module (Q2) through a first resister (R1), and an output of the third current source connecting to a grounding voltage supply through a second resister (R2);

a current summing circuit for providing three current paths to the grounding voltage supply through third, fourth and fifth resistors (R3, R4, and R5) respectively, wherein the outputs of the first current source and the third current source are buffered and connected to the grounding voltage supply through the third and fourth resistors respectively, wherein a temperature independent reference voltage ($V_{REF}$) across the fifth resistor is generated when an emitter voltage of Q1 ($V_{be1}$), an emitter voltage of Q2 ($V_{be2}$), and the resistors bear a predetermined relationship as represented mathematically by $(R5/R3)*dV_{be1}/dT+((R2*R5)/(R1*R4))*d(V_{be1}-V_{be2})/dT=0$, wherein $dV_{be1}/dT$ and $d(V_{be1}-V_{be2})/dT$ are respective changes of the emitter voltage of the first BJT device module and a difference between the emitter voltages of the first BJT device module and the second BJT device module with respect to temperature.

12. The circuit of claim 11 further comprising an operational amplifier with its positive input connected to the output of the first current source and negative input connected with the output of the second current source.

13. The circuit of claim 11 wherein the current summing circuit provides the current through the fifth resistor to be proportional to the summation of the currents through the third resistor and the fourth resistor.

14. The circuit of claim 11 wherein the second BJT device module has a predetermined number of BJT transistors similar to the first BJT device module connected in parallel.

15. The circuit of claim 11 wherein the reference voltage is less than or equal to about 1V.

16. The circuit of claim 11 wherein a supply voltage of the circuit is less than about 1V.

17. The circuit of claim 11 wherein the first BJT device module is a pnp type and receives the output of the first current source at its emitter, and wherein the second BJT device module is a pnp type and receives the output of the second current source at its emitter through the first resistor.

18. The circuit of claim 11 further comprises first and second unit gain buffers setting voltages across the third resistor and the fourth resistors by passing the outputs of the first current source and the third current source.

19. A method for generating a temperature independent reference voltage, the method comprising:

generating first, second and third current outputs (102, 104, and 106) with the first current source feeding into an emitter of a first pnp BJT device module (Q1), the second current source feeding into an emitter of a second pnp BJT device module (Q2) through a first resistor (R1), and the third current source connecting to a grounding voltage supply through a second resistor (R2);

providing three current paths from a current summing circuit to the ground voltage supply through third, forth and fifth resistors (R3, R4, and R5) respectively;

imposing an emitter voltage of Q1 ($V_{be1}$) across the third resistor;

imposing a voltage across the second resistor to be across the fourth resistor, wherein a temperature independent reference voltage ($V_{REF}$) across the fifth resistor is generated when $V_{be1}$, an emitter voltage of Q2 ($V_{be2}$), and the resistors bear a predetermined relationship as represented mathematically by $(R5/R3)*dV_{be1}/dT+((R2*R5)/(R1*R4))*d(V_{be1}-V_{be2})/dT=0$, wherein $dV_{be1}/dT$ and $d(V_{be1}-V_{be2})/dT$ are respective changes of the emitter voltage of the first pnp BJT device module and a difference between the emitter voltages of the first pnp BJT device module and the second pnp BJT device module with respect to temperature.

20. The method of claim 19 further comprising using an operational amplifier with its negative input connected to the first current source and positive input connected with the second current source for maintaining a same current through the first pnp BJT device module and the second pnp BJT device module.

21. The method of claim 19 wherein the current summing circuit provides the current through the fifth resistor to be proportional to the summation of the currents through the third resistor and the fourth resistor.

22. The method of claim 19 wherein the reference voltage is less than or equal to about 1V.

* * * * *